US009772156B1

(12) United States Patent
Viviano et al.

(10) Patent No.: US 9,772,156 B1
(45) Date of Patent: Sep. 26, 2017

(54) METHOD OF INSTALLING AND REMOVING A SAFETY SELECTOR

(71) Applicant: Smith & Wesson Corp., Springfield, MA (US)

(72) Inventors: Matteo Vincenzio Viviano, Harrison Township, MI (US); Joshua Raymond Lloyd, Brimfield, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/498,851

(22) Filed: Apr. 27, 2017

Related U.S. Application Data

(62) Division of application No. 15/233,357, filed on Aug. 10, 2016.

(51) Int. Cl.
*F41A 17/46* (2006.01)
*F41A 17/56* (2006.01)
*F41A 17/64* (2006.01)
*F41A 17/74* (2006.01)

(52) U.S. Cl.
CPC ..... *F41A 17/46* (2013.01)

(58) Field of Classification Search
CPC ..... F41A 17/46; F41A 17/56; F41A 17/74; F41A 17/64
USPC ..... 89/142, 148, 149, 150; 42/70.01, 70.04, 42/70.06, 70.07, 70.08
See application file for complete search history.

(56) References Cited

U.S. PATENT DOCUMENTS 995,790 A 6/1911 Johnson
1,065,342 A * 6/1913 Browning ..... F41A 17/64 89/145
1,934,731 A * 11/1933 Nahm ..... F42C 7/12 137/551
2,110,317 A 3/1938 Ernst
2,174,851 A * 10/1939 Williams ..... F41A 17/56 89/144
2,225,583 A * 12/1940 Blizard ..... F41A 17/46 42/70.06
2,379,946 A * 7/1945 Baker ..... F41A 17/46 42/70.06
2,383,487 A * 8/1945 Johnson, Jr. ..... F41A 19/02 89/141
2,453,683 A * 11/1948 Caldow ..... F41A 17/46 42/70.04
2,501,254 A * 3/1950 Beaver ..... F41A 17/46 42/70.06
2,856,718 A * 10/1958 Fischer ..... F41A 17/46 42/70.05

(Continued)

*Primary Examiner* — Derrick Morgan
(74) *Attorney, Agent, or Firm* — John A. Chionchio, Esquire; Ballard Spahr LLP

(57) ABSTRACT

A method of installing a safety selector in a firearm includes inserting the safety selector into an opening in the firearm, aligning a hole extending through the safety selector with a cavity extending transversely from the opening, inserting a spring through the hole and into the cavity, inserting a detent plunger through the hole and at least partially into the cavity, thereby compressing the spring, and moving the safety selector within the opening transversely to the cavity so as to capture the detent plunger at least partially within the cavity. The invention also encompasses a method of removing the safety selector.

5 Claims, 5 Drawing Sheets

(56) References Cited

U.S. PATENT DOCUMENTS 2,926,447 A * 3/1960 Scripter ..... F41A 17/56 42/41
3,208,177 A * 9/1965 Barr ..... F41A 17/00 42/21
3,209,480 A * 10/1965 Mittelsteadt ..... F41A 17/74 42/41
3,257,749 A 6/1966 Stanley
3,442,173 A * 5/1969 Muller ..... F41A 19/21 42/105
3,979,850 A 9/1976 Schlessl
4,002,101 A * 1/1977 Tellie ..... F41A 19/33 42/70.06
4,422,254 A * 12/1983 McQueen ..... F41A 17/46 42/70.05
4,926,575 A 5/1990 Pastor
5,068,990 A * 12/1991 Marzocco ..... F41A 17/56 42/70.04
5,206,445 A * 4/1993 Comley ..... F41A 19/07 42/105
5,245,776 A * 9/1993 Dornaus ..... F41A 17/72 42/144
5,417,001 A * 5/1995 Rousseau ..... F41A 17/30 42/69.03
5,458,369 A 10/1995 Matsuki
5,467,550 A * 11/1995 Mumbleau ..... F41A 17/02 42/70.11
5,711,286 A * 1/1998 Petrosyan ..... F41B 11/62 124/53
5,784,819 A 7/1998 Roper
5,946,841 A 9/1999 Roper
6,141,896 A * 11/2000 Oberst ..... F41A 17/02 42/70.06
6,173,518 B1 1/2001 Oberst
6,256,917 B1 * 7/2001 Findlay ..... F41A 17/02 42/70.06
D458,333 S * 6/2002 Power ..... D22/108
6,513,273 B2 * 2/2003 da Silveira ..... F41A 17/02 42/16
6,550,176 B2 * 4/2003 Beretta ..... F41A 17/02 42/70.04
6,871,437 B1 * 3/2005 Bartozzi ..... F41A 17/02 42/70.01
6,880,281 B1 * 4/2005 Orr ..... F41A 17/46 42/69.01
7,147,420 B2 * 12/2006 Baus ..... F16B 21/125 411/347
7,941,954 B2 * 5/2011 Carr ..... F41C 23/10 42/36
8,069,606 B1 * 12/2011 Saur ..... F41A 11/00 29/278
8,186,087 B2 5/2012 Ogershok
8,464,459 B1 6/2013 Summers
8,499,482 B1 8/2013 DiTrolio
8,650,789 B2 * 2/2014 Dionne ..... F41A 17/00 42/70.01
8,756,847 B2 6/2014 Huther
9,389,031 B2 * 7/2016 Gardner ..... F41A 3/66
9,587,897 B1 3/2017 Huang
2002/0194764 A1 * 12/2002 Beretta ..... F41A 17/02 42/70.11
2003/0213159 A1 11/2003 Cutini
2005/0229461 A1 * 10/2005 McGarry ..... F41A 17/56 42/70.08
2008/0086926 A1 * 4/2008 Quis ..... F41A 19/46 42/17
2009/0044438 A1 * 2/2009 Yollu ..... F41A 17/46 42/70.06
2012/0180354 A1 7/2012 Sullivan
2013/0111794 A1 * 5/2013 Dionne ..... F41A 17/00 42/70.01
2013/0111796 A1 * 5/2013 Dionne ..... F41A 17/00 42/70.11
2015/0198401 A1 7/2015 Locher
2016/0091268 A1 * 3/2016 Miller, III ..... F41A 17/46 42/70.06
2016/0187090 A1 6/2016 Mather
2017/0089655 A1 * 3/2017 Geissele ..... F41A 19/46

* cited by examiner

FIG. 1
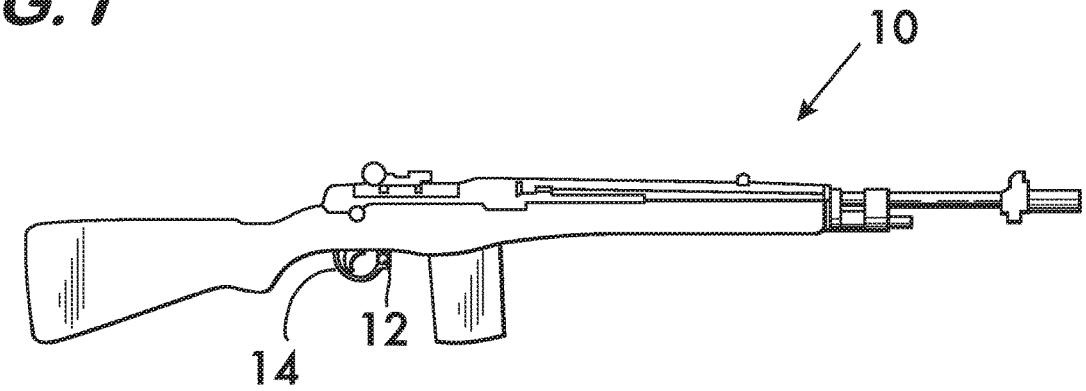
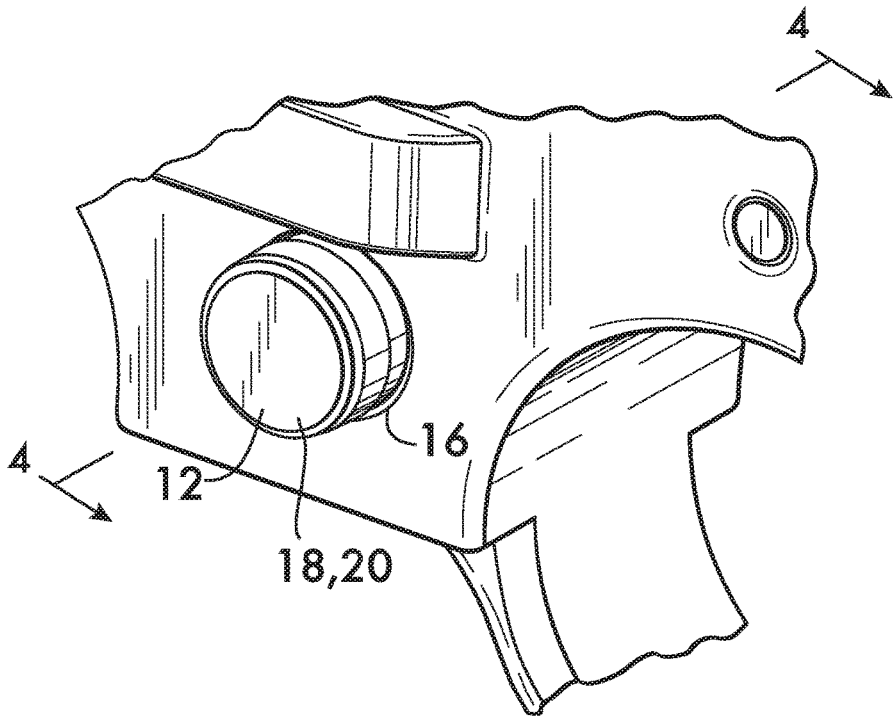
FIG. 2

FIG. 5
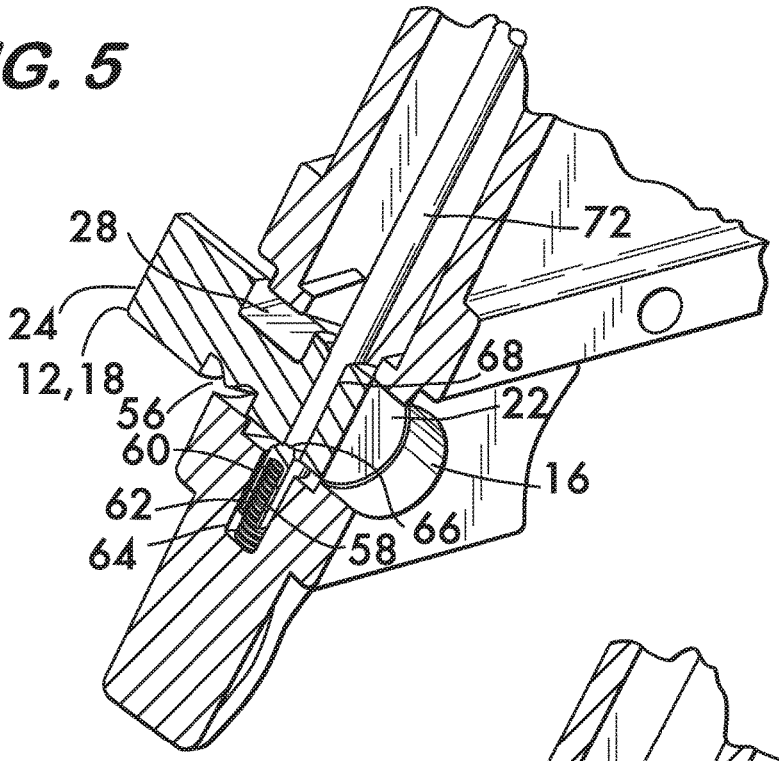
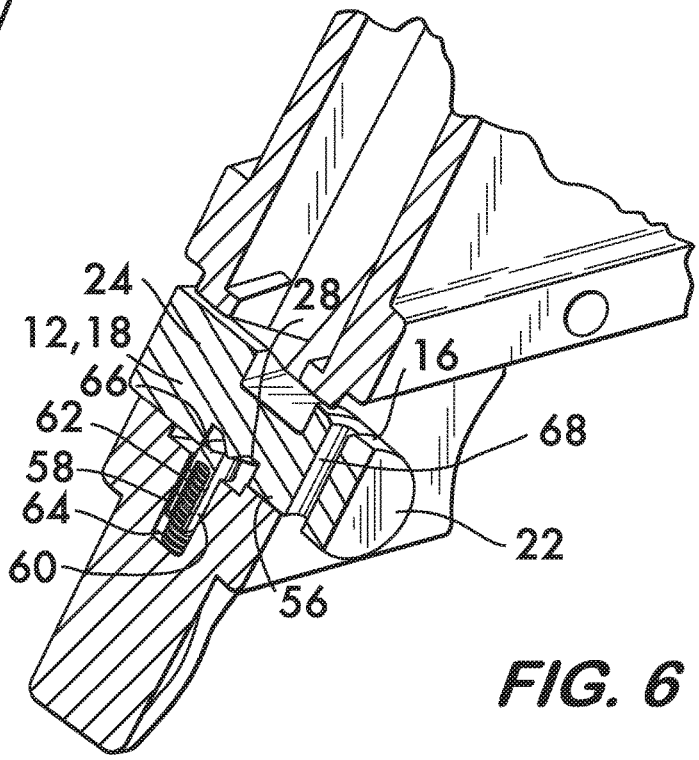
FIG. 6

FIG. 9
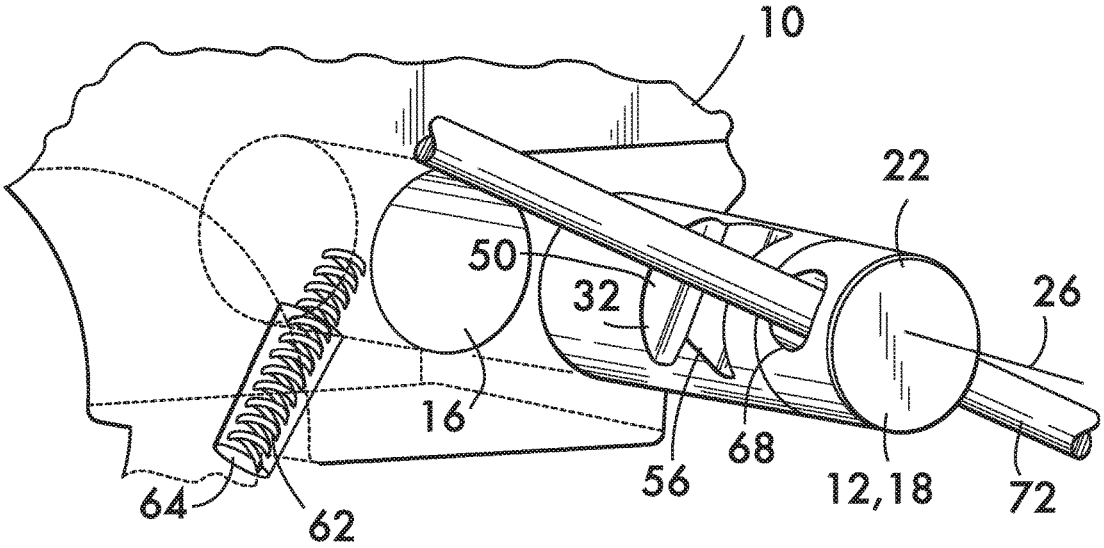
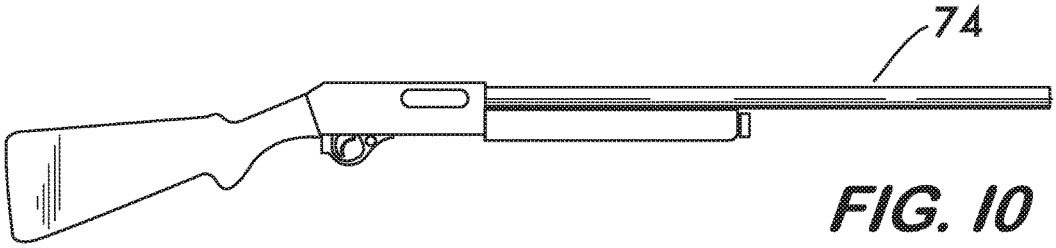
FIG. 10
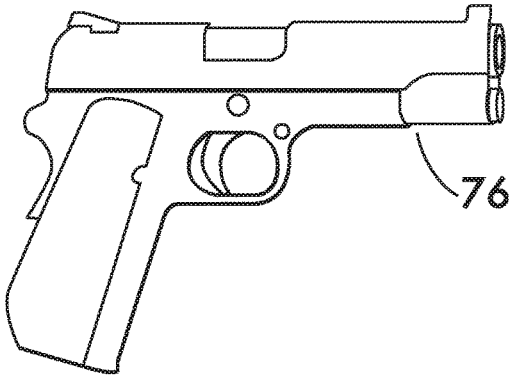
FIG. 11

METHOD OF INSTALLING AND REMOVING A SAFETY SELECTOR

CROSS REFERENCE TO RELATED APPLICATION

This application is a divisional application of U.S. application Ser. No. 15/233,357, filed Aug. 10, 2016 and hereby incorporated by reference.

FIELD OF THE INVENTION

This invention relates to safety selectors for firearms, and to methods for installing and removing safety selectors.

BACKGROUND

Armorers display considerable skill, ingenuity and manual dexterity in the assembly of firearm mechanisms, which are often complex and require the manipulation of relatively small parts in confined workspaces within the receivers of shotguns and rifles as well as within the frame of a pistol. Spring biased parts, such as detents, present a particular challenge because force must often be maintained on the parts to keep the biasing spring compressed while other parts are manipulated. Additionally, unless laterally supported, long springs buckle under the slightest compressive load, thereby complicating the assembly process further. There is clearly an opportunity to provide design enhancements of parts which provide advantages to assembly and disassembly of firearm mechanisms.

SUMMARY

The invention concerns a safety selector for a firearm. In one example embodiment the safety selector comprises a body having first and second ends oppositely disposed. A first axis extends between the first and second ends. A first cutout is positioned in the body between the first and second ends. A second and a third cutout are positioned in the body between the first and second ends. The second and third cutouts are positioned adjacent to one another along the first axis. The second and third cutouts are angularly displaced from the first cutout about the first axis. A hole extends through the body along a second axis oriented transversely to the first axis. The hole is positioned proximate to the first end of the body.

In a particular example embodiment the body comprises a cylinder. Further by way of example, the hole has a round cross sectional shape. In an example embodiment, the second axis is oriented perpendicular to the first axis. In a specific example embodiment, the second and third cutouts are displaced about the first axis at an angle of 45° from aid first cutout. By way of example, the first cutout comprises an elongate notch extending lengthwise along the first axis. In an example embodiment, the notch is defined by a pair of end surfaces arranged in spaced relation and oriented perpendicular to the first axis, and a floor surface, oriented perpendicular to and extending between the end surfaces. Further by way of example, the end surfaces and the floor surface are flat. In an example embodiment the second cutout is defined by an end surface oriented perpendicular to the first axis, a floor surface oriented parallel to the first axis, and an oblique surface oriented transversely to the first axis. In another example embodiment, the third cutout is defined by an end surface oriented perpendicular to the first axis. A floor surface is oriented parallel to the first axis and an oblique surface is oriented transversely to the first axis. In this example the oblique surface of the third cutout is contiguous with the oblique surface of the second cutout.

The invention also encompasses a firearm having a safety selector received within an opening adjacent to a trigger. In an example embodiment the safety selector comprises a body having first and second ends oppositely disposed. A first axis extends between the first and second ends. A first cutout is positioned in the body between the first and second ends. A second and a third cutout are positioned in the body between the first and second ends. The second and third cutouts are positioned adjacent to one another along the first axis. The second and third cutouts are angularly displaced from the first cutout about the first axis. A hole extends through the body along a second axis oriented transversely to the first axis. The hole is positioned proximate to the first end of the body in this example.

In a specific example embodiment the body comprises a cylinder. Further by way of example, the hole has a round cross sectional shape. In another example the second axis is oriented perpendicular to the first axis. In a specific example embodiment the second and third cutouts are displaced about the first axis at an angle of 45° from aid first cutout. In an example embodiment the first cutout comprises an elongate notch extending lengthwise along the first axis. In a particular example embodiment the notch is defined by a pair of end surfaces arranged in spaced relation and oriented perpendicular to the first axis and a floor surface oriented perpendicular to and extending between the end surfaces. By way of example the end surfaces and the floor surface are flat. In a further example the second cutout is defined by an end surface oriented perpendicular to the first axis, and a floor surface is oriented parallel to the first axis, and an oblique surface is oriented transversely to the first axis.

In another example the third cutout is defined by an end surface oriented perpendicular to the first axis, a floor surface is oriented parallel to the first axis and an oblique surface is oriented transversely to the first axis. In this example the oblique surface of the third cutout is contiguous with the oblique surface of the second cutout.

It is contemplated that an example firearm according to the invention could be a rifle, a shotgun or a pistol.

The invention also encompasses a method of installing a safety selector in a firearm having an opening receiving the safety selector, a cavity extending transversely from the opening receiving a spring, and a detent plunger engaged with the spring. In one example embodiment the method comprises:

- inserting the safety selector into the opening;
- aligning a hole extending through the safety selector with the cavity;
- inserting the spring through the hole and into the cavity;
- inserting the detent plunger through the hole and at least partially into the cavity, thereby compressing the spring; and
- moving the safety selector within the opening transversely to the cavity so as to capture the detent plunger at least partially within the cavity.

An example method further comprises using a tool to insert the detent plunger through the hole and into the cavity.

Further by way of example, the method comprises moving the safety selector into contact with an end of the detent plunger before removing the tool.

The invention also encompasses a method of removing a safety selector in a firearm having an opening receiving the safety selector, a cavity extending transversely from the opening receiving a spring, and a detent plunger engaged with the spring. In one example embodiment the method comprises:

inserting a tool into a hole extending through the safety selector;

rotating the safety selector about an axis oriented perpendicular to the cavity to position the detent plunger against an outer surface of the safety selector which forces the detent plunger completely into the cavity; and withdrawing the safety selector from the opening.

An example method further comprises positioning the safety selector so as to expose the hole extending through the safety selector to the ambient.

BRIEF DESCRIPTION OF THE DRAWINGS

FIG. 1 is a side view of an example firearm having a safety selector according to the invention;

FIG. 2 is an isometric view of a portion of the firearm of FIG. 1 showing an example embodiment of a safety selector according to the invention;

FIGS. 4-6 are partial sectional isometric views taken at line 4-4 of FIG. 2 illustrating an example method of installing a safety selector in a firearm;

FIGS. 7-9 are partial isometric views illustrating an example method of removing a safety selector from a firearm;

FIG. 10 is a side view of a shotgun using a safety selector according to the invention; and FIG. 11 is a side view of a pistol using a safety selector according to the invention.

DETAILED DESCRIPTION

Figure 3:
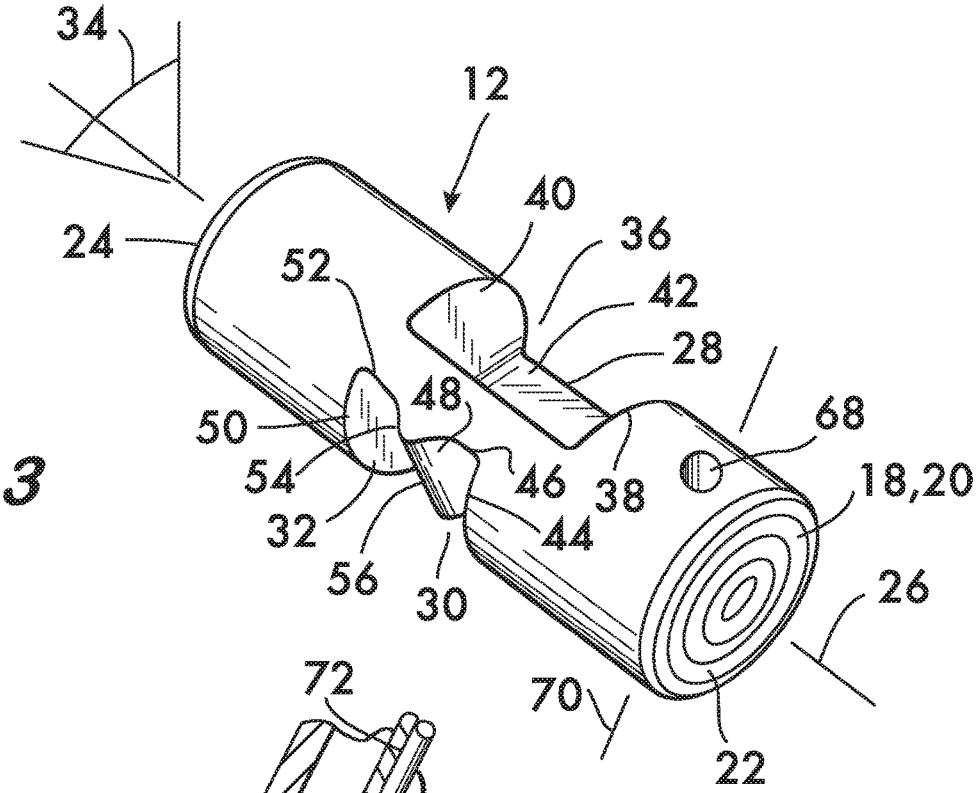
FIG. 3 is an isometric view of an example safety selector according to the invention.

FIG. 1 shows an example firearm, a rifle 10 according to the invention. A safety selector 12, shown in detail in FIG. 2, is positioned adjacent to the trigger 14. Selector 12 is received within an opening 16 and comprises a body 18. In this example body 18 comprises a cylinder 20. As shown in FIG. 3, body 18 has first and second ends 22 and 24 oppositely disposed. A first (longitudinal) axis 26 extends between the ends 22 and 24. A first cutout 28 is positioned in body 18 between the ends 22 and 24. Second and third cutouts 30 and 32 are also positioned in body 18 between ends 22 and 24. The second and third cutouts 30 and 32 are positioned adjacent to one another along the axis 26 and are angularly offset from the first cutout 28 about axis 26. In this example the second and third cutouts 30 and 32 are displaced from the first cutout 28 at an offset angle 34 of 45°, other offset angles being feasible.

In the example selector 12 shown, the first cutout 28 in body 18 comprises an elongate notch 36 which extends lengthwise along the axis 26. Notch 36 is defined by a pair of end surfaces 38 and 40 arranged in spaced relation from one another. End surfaces 38 and 40 are flat in this example and oriented perpendicular to axis 26. A floor surface 42 extends between the end surfaces 38 and 40. In this example floor surface 42 is also flat and is oriented perpendicular to the end surfaces 38 and 40. Second cutout 30 is defined by an end surface 44 oriented perpendicular to the axis 26, a floor surface 46 oriented parallel to axis 26, and an oblique surface 48 oriented transversely to the axis 26. Similarly, third cutout 32 is defined by an end surface 50 oriented perpendicular to the axis 26, a floor surface 52 oriented parallel to axis 26, and an oblique surface 54 oriented transversely to the axis 26. In this example the oblique surface 54 of the third cutout 32 is contiguous with the oblique surface 48 of the second cutout 30.

The region of body 18 defined by the second and third cutouts 30 and 32 is known as the "crown" 56 due to its undulating shape. As shown in FIG. 6, the crown 56 engages a detent 58 when the selector 12 is installed in the opening 16 of rifle 10. As shown in FIG. 3, detent 58 comprises a detent plunger 60 and a detent spring 62. Plunger 60 and spring 62 are positioned within a cavity 64 in the rifle 10 which extends transversely from opening 16 which receives the selector 12. Spring 62 biases the plunger 60 into engagement with the crown 56 (see FIG. 6) to secure the selector 12 in one of two desired positions, "safe" and "fire". Selector 12 is slidlably movable within opening 16 between these two positions. The detent 58 holds the selector 12 both within the opening 16 and in the desired position. Application of sufficient force to either end 22, 24 of body 18 will move the selector between the safe and fire positions. This movement is permitted by the contiguous oblique surfaces 48 and 54 (see FIG. 3), which act as ramps along which the plunger 60 may move as it transitions between positions. The angular orientation of the oblique surfaces 48 and 54 is selected so that it simultaneously permits movement of body 18 between the safe and fire positions upon the manual application of a threshold force, but resists movement of body 18 by a force lower than the threshold, for example, inertial forces caused by dropping the rifle, so that the status of the rifle, i.e., safe or fire, does not change inadvertently. Motion of the plunger 60 over the oblique surfaces 48 and 54 is aided by providing the plunger with a conical or rounded end 66. The end surfaces 44 and 50 of the second and third cutouts 30 and 32, being perpendicular to the axis 26 (see FIG. 3), prevent the body 18 from being withdrawn from opening 16 while the plunger 60 is engaged with the crown 56.

The second and third cutouts 30 and 32 are angularly offset from the first cutout 28 such that when crown 56 engages the detent 58 the first cutout 28 interacts with the fire control system of the rifle 10 to either permit discharge ("fire" position selected) or prevent discharge ("safe" position selected) of the firearm. There are many different fire control safety mechanisms. For example, motion of the selector 12 to the safe position may block trigger movement, hammer movement, sear movement, or may disengage a trigger bar from the sear. As these mechanisms are well understood, and the selector 12 according to the invention will work with many of them, they are not explained in detail.

It is a challenge for armorers to install the detent 58 and the selector 12 thus far described. To allow for easier installation, selectors 12 according to the invention also comprise a hole 68 which extends through body 18 (see FIGS. 3 and 4). Hole 68 extends along a second axis 70 oriented transversely to the first axis 26. In the example embodiment described herein the hole 68 has a round cross section and second axis 70 is oriented perpendicular to the first axis 26. Hole 68 is positioned proximate to the first end 22 of the body 18.

Figure 4:
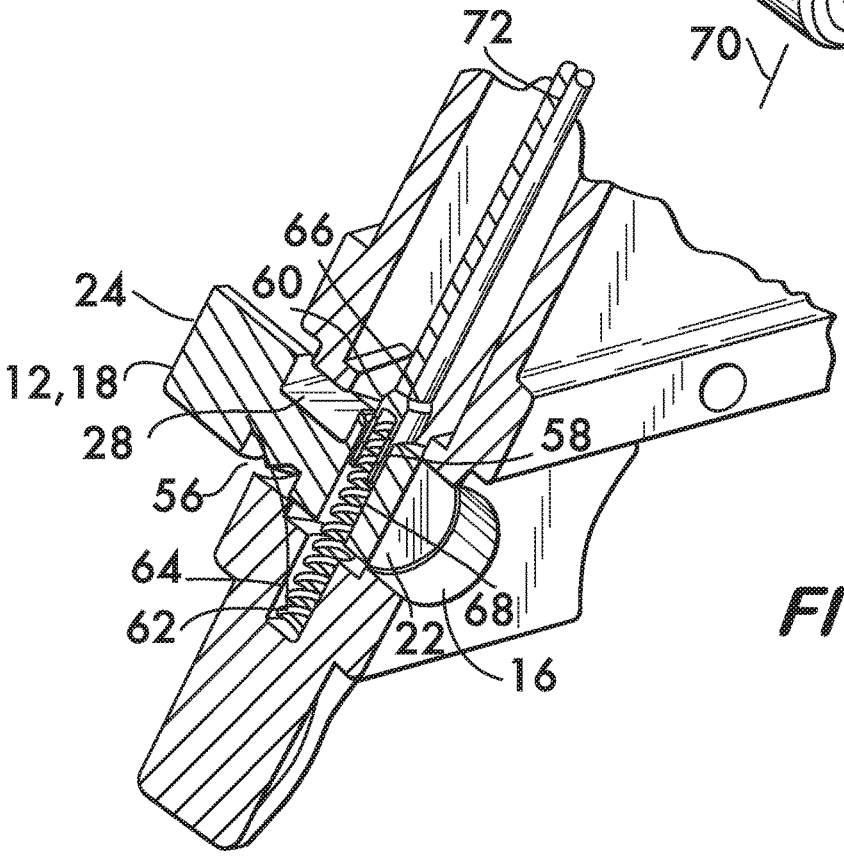

FIGS. 4-6 illustrate an example method for installing selector 12 according to the invention. As shown in FIG. 4, body 18 of the selector 12 is inserted into the opening 16. Hole 68 in body 18 is aligned with the cavity 64. The spring 62 is then inserted through hole 68 and into the cavity 64. The plunger 60 is then inserted into the hole 68 and into engagement with spring 62. As shown in FIGS. 4 and 5, the detent plunger is pressed against spring 62 into the cavity 64, compressing spring 62. Note that spring 62 is laterally supported within the cavity 64 and the body 18 and cannot buckle. In this example a tool, such as a punch 72, is used to force the detent plunger through hole 68 and into the cavity 64. As shown in FIG. 5, detent plunger 60 is inserted into the cavity 64 sufficiently to permit body 18 to be moved transversely to the cavity 64. Motion of the body 18 moves the crown 56 toward the detent 58. Upon motion of the body within opening 16 an edge of the hole 68 catches the plunger end 66 and holds the plunger against the biasing force of the compressed spring 62. This permits the punch 72 to be removed. The conical shape of plunger end 66 aids this process. Upon further motion of the body 18 the plunger end 66 rides on the surface of the body 18 and then snaps into the second cutout 30. The remaining components of the rifle are then assembled and the safety selector 12 can be positioned reliably in one of its two positions.

Figure 7:
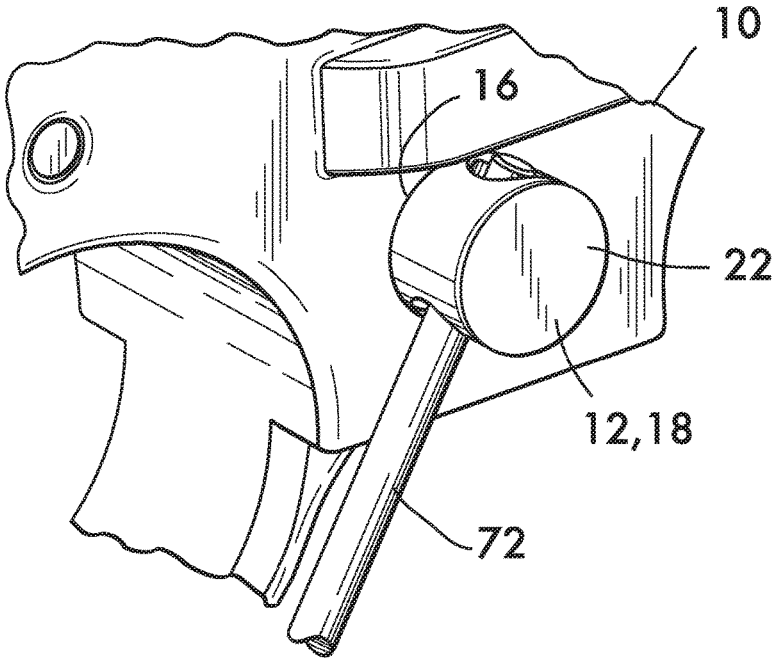
Figure 8:
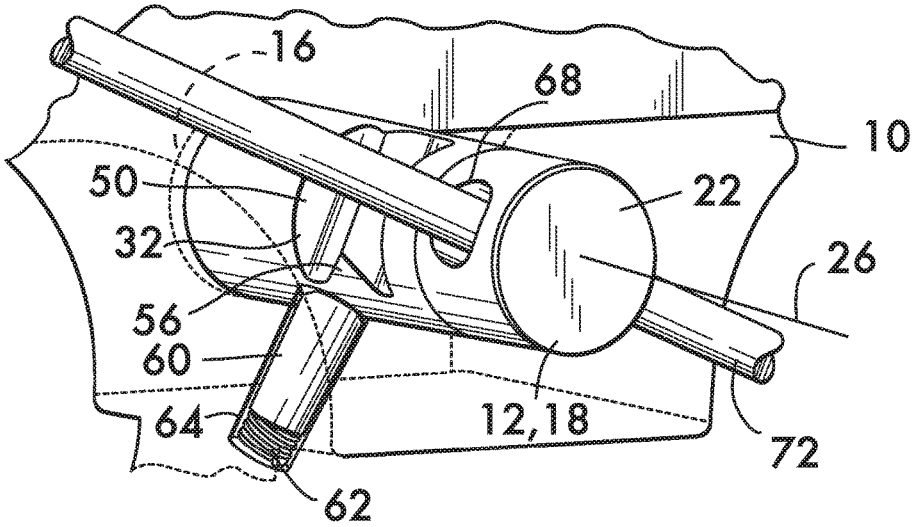

An example method for removing the safety selector 12 is illustrated in FIGS. 7-9. As shown in FIG. 7, if necessary, the selector 12 is moved to a position that will expose the hole 68 to the ambient. In this example the selector 12 is moved to the "safe" position. The tool, punch 72 is then inserted into hole 68. As shown in FIG. 8, the body 18 is then rotated about axis 26 using punch 72. Body 18 is rotated to position the end 66 of plunger 60 on a surface of the body that is not within the crown 56. With the body 18 rotated to such a position the plunger 60 will not engage the end surface 50 of the third cutout 32 if the body 18 is moved in the direction of axis 26. Thus it will be possible to remove body 18 from hole 68, as shown in FIG. 9.

It is expected that safety selectors according to the invention will reduce assembly time of long guns such as rifles 10, shotguns 74 and pistols 76 in which they, and their associated methods of assembly and disassembly, are used.

What is claimed is:

1. A method of installing a safety selector in a firearm having an opening receiving said safety selector, a cavity extending transversely from said opening receiving a spring, and a detent plunger engaged with said spring, said method comprising:

inserting said safety selector into said opening;

aligning a hole extending through said safety selector with said cavity;

inserting said spring through said hole and into said cavity;

inserting said detent plunger through said hole and at least partially into said cavity, thereby compressing said spring; and moving said safety selector within said opening transversely to said cavity so as to capture said detent plunger at least partially within said cavity.

2. The method according to claim 1, further comprising using a tool to insert said detent plunger through said hole and into said cavity.

3. The method according to claim 2, further comprising moving said safety selector into contact with an end of said detent plunger before removing said tool.

4. A method of removing a safety selector in a firearm having an opening receiving said safety selector, a cavity extending transversely from said opening receiving a spring, and a detent plunger engaged with said spring, said method comprising:

inserting a tool into a hole extending through said safety selector;

rotating said safety selector about an axis oriented perpendicular to said cavity to position said detent plunger against an outer surface of said safety selector which forces said detent plunger completely into said cavity; and withdrawing said safety selector from said opening.

5. The method according to claim 4, further comprising positioning said safety selector so as to expose said hole extending through said safety selector to the ambient.

* * * * *